US007671098B2

(12) United States Patent
Leinweber et al.

(10) Patent No.: US 7,671,098 B2
(45) Date of Patent: Mar. 2, 2010

(54) ALKOXYLATED, CROSS-LINKED POLYGLYCEROLS AND USE THEREOF AS BIODEGRADABLE DEMULSIFIER

(75) Inventors: Dirk Leinweber, Schwalbach (DE); Franz-Xaver Scherl, Burgkirchen (DE); Elisabeth Wasmund, Burgkirchen (DE); Heidi Rausch, Garching/Alz (DE)

(73) Assignee: Clariant Produkte (Deutschland) GmbH, Sulzbach (DE)

( * ) Notice: Subject to any disclaimer, the term of this patent is extended or adjusted under 35 U.S.C. 154(b) by 752 days.

(21) Appl. No.: 10/559,719

(22) PCT Filed: May 25, 2004

(86) PCT No.: PCT/EP2004/005587

§ 371 (c)(1),
(2), (4) Date: Dec. 5, 2005

(87) PCT Pub. No.: WO2004/008863

PCT Pub. Date: Dec. 16, 2004

(65) Prior Publication Data

US 2006/0281931 A1 Dec. 14, 2006

(30) Foreign Application Priority Data

Jun. 4, 2003 (DE) ..... 103 25 198

(51) Int. Cl.
*B01D 17/05* (2006.01)

(52) U.S. Cl. ..... 516/173; 516/181; 516/182; 516/183

(58) Field of Classification Search ..... 516/173
See application file for complete search history.

(56) References Cited

U.S. PATENT DOCUMENTS

| | | | | |
|---|---|---|---|---|
| 2,944,982 A | | 7/1960 | De Groote | |
| 3,110,737 A | | 11/1963 | De Groote | |
| 4,061,684 A | | 12/1977 | Helfert | |
| 4,263,178 A | | 4/1981 | Guth | |
| 4,321,146 A | | 3/1982 | McCoy | |
| 4,342,657 A | | 8/1982 | Blair | |
| 5,164,116 A | * | 11/1992 | Berkhof et al. | 516/179 |
| 5,445,765 A | | 8/1995 | Elfers | |
| 5,502,219 A | | 3/1996 | Harris | |
| 5,759,409 A | | 6/1998 | Knauf et al. | |
| 5,981,687 A | | 11/1999 | Breen | |
| 2004/0072916 A1 | | 4/2004 | Leinweber | |

FOREIGN PATENT DOCUMENTS

| | | |
|---|---|---|
| CA | 205 7425 | 6/1992 |
| CA | 206 1174 | 8/1992 |
| DE | 229 006 | 10/1985 |
| WO | WO 98/03243 | 1/1998 |

OTHER PUBLICATIONS

Knischka et al., "Functional Poly(ethylene oxide) Multiarm Star Polymers: Core-First Synthesis Using Hyperbranched Polyglycerol Initiators", Macromolecules, 2000, 33 (2), pp. 315-320, Dec. 29, 1999.*
English Language Abstract of DD 229 006, Oct. 30, 1985.
English language Abstract of WO 98/03243, Jan. 29, 1998.

* cited by examiner

*Primary Examiner*—Ling-Siu Choi
*Assistant Examiner*—Chun-Cheng Wang
(74) *Attorney, Agent, or Firm*—Tod A. Waldrop

(57) ABSTRACT

The invention relates to the use of alkoxylated crosslinked polyglycerols for demulsifying oil/water emulsions in amounts of from 0.0001 to 5% by weight, based on the oil content of the emulsion to be demulsified. The alkoxylated crosslinked polyglycerols of the invention is crosslinked with multifunctional electrophilic compounds having a molecular weight of from 1000 to 100 000 units and which comprise 5 to 100 glycerol units which are alkoxylated with $C_2$-$C_4$-alkylene oxide groups or a mixture of such alkylene oxide groups so that the crosslinked alkoxylated polyglycerols have a degree of alkoxylation of from 1 to 100 alkylene oxide units per free OH group.

8 Claims, No Drawings

ALKOXYLATED, CROSS-LINKED POLYGLYCEROLS AND USE THEREOF AS BIODEGRADABLE DEMULSIFIER

The present invention relates to the use of alkoxylated, cross-linked polyglycerols for demulsifying water-oil emulsions, in particular in the production of crude oil.

During its recovery, crude oil is produced as an emulsion with water. Before the crude oil is further processed, these crude oil emulsions must be demulsified into the oil and water constituents. For this purpose, use is generally made of petroleum demulsifiers. Petroleum demulsifiers are interface-active polymeric compounds which are able to effect the required separation of the emulsion constituents within a short time.

Disclosed petroleum demulsifiers are, in U.S. Pat. No. 4,321,146, alkylene oxide block copolymers and, in U.S. Pat. No. 5,445,765, alkoxylated polyethyleneimines. These can be used as individual components, in mixtures with other demulsifiers, or else as crosslinked products. Crosslinkings are carried out, for example, by reactions of alkoxylated low molecular weight alcohols (such as, for example, glycerol or pentaerythrol) or alkoxylated alkylphenol formaldehyde resins with bifunctional compounds such as diepoxides or diisocyanates. Such crosslinked compounds are disclosed in U.S. Pat. No. 5,759,409 and U.S. Pat. No. 5,981,687.

The use of alkoxylated glycerol as demulsifying constituent in lubricating oils has been described in DD-229006. Here, glycerol is reacted with alkylene oxides either to give a block copolymer or a random copolymer.

The use of alkoxylated di- and triglycerols as petroleum demulsifiers has likewise been described (U.S. Pat. Nos. 3,110,737, 2,944,982 and 4,342,657).

Alkoxylated polyglycerols are known per se. They are described in the prior art for various applications. For example, in U.S. Pat. No. 5,502,219, alkoxylated polyglycerols were esterified in order to prepare a low-calorie substitute for plant oils. In U.S. Pat. No. 4,061,684, the alkoxylated polyglycerols were esterified and used as gels which swell in water. Alkoxylated polyglycerols which have been reacted with alpha-olefin epoxides act, according to WO-98/03243, as antifoams. The sulfation of alkoxylated polyglycerols leads to substances which are used in hair shampoos, as disclosed in U.S. Pat. No. 4,263,178.

Alkoxylated polyglycerols have been disclosed in DE 101 07 880 A1 as effective demulsifiers.

The various properties (e.g. asphaltene, paraffin and salt content, chemical composition of the natural emulsifiers) and proportions of water in various crude oils make it imperative to further develop the existing petroleum demulsifiers. In particular, a low dosing rate and broad applicability of the petroleum demulsifier to be used as well as the relatively high effectiveness to be strived for is at the forefront from an economic and ecological point of view. There is also an increasing need for demulsifiers which have good biodegradability and low bioaccumulation in order to replace the alkylphenol-based products under discussion.

The object was thus to develop novel petroleum demulsifiers which are superior in their effect to the already known alkoxylated polyglycerols, can be used in an even lower concentration and have better biodegradability.

Surprisingly, it has been found that alkoxylated, crosslinked polyglycerols exhibit an excellent effect as petroleum demulsifiers even at a very low concentration. In addition, they exhibited markedly better biodegradabilities (according to OECD 306) in comparison with customary commercial demulsifiers and alkoxylated, uncrosslinked polyglycerols.

The invention therefore provides for the use of alkoxylated polyglycerols crosslinked with multifunctional electrophilic compounds with a molecular weight of from 1000 to 100 000 units which comprise 5 to 100 glycerol units which are alkoxylated with $C_2$-$C_4$-alkylene oxide groups or a mixture of such alkylene oxide groups so that the crosslinked alkoxylated polyglycerol has a degree of alkoxylation of from 1 to 100 alkylene oxide units per free OH group, for demulsifying oil/water emulsions in amounts of from 0.0001 to 5% by weight, based on the oil content of the emulsion to be demulsified.

These alkoxylated, crosslinked polyglycerols are obtainable from crosslinked polyglycerols having 5 to 100 glycerol units by alkoxylation of the free OH groups with a $C_2$-$C_4$-alkylene oxide or a mixture of such alkylene oxides in molar excess, such that the alkoxylated crosslinked polyglycerol has said degree of alkoxylation.

The preparation of polyglycerol is known in the prior art and takes place generally by acid- or alkali-catalyzed condensation of glycerol. The reaction temperature is generally between 150 and 300° C., preferably 200 to 250° C. The reaction is normally carried out at atmospheric pressure. Examples of catalyzing acids are HCl, $H_2SO_4$, sulfonic acids or $H_3PO_4$, and bases which may be mentioned are NaOH or KOH, which are used in amounts of from 0.1 to 50% by weight, based on the weight of the reaction mixture. The condensation generally requires 3 to 10 hours. Polyglycerols can be depicted by formula 1.

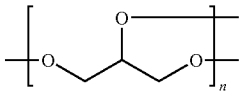

(1)

In formula 1, n is the degree of condensation, i.e. the number of glycerol units. n increases with increasing reaction time and is determined by means of the OH number.

In the next step, the polyglycerols prepared in this way are crosslinked with di- or multifunctional, electrophilic compounds. This achieves a very easily controllable increase in the molecular weight of the polyglycerols. The crosslinkers used are, inter alia, di- and polyglycidyl ethers, di- and polyepoxides, di- and polycarboxylic acids, carboxylic anhydrides, di- and polyisocyanates, dialkoxydialkylsilanes, trialkoxyalkylsilanes, and tetra-alkoxysilanes. The crosslinking is carried out as known in the prior art.

The following crosslinkers are particularly preferred:

bisphenol A diglycidyl ether, butane-1,4-diol diglycidyl ether, hexane-1,6-diol diglycidyl ether, ethylene glycol diglycidyl ether, cyclo-hexanedimethanol diglycidyl ether, resorcinol diglycidyl ether, glycerol diglycidyl ether, glycerol triglycidyl ether, glycerol propoxylate triglycidyl ether, polyglycerol polyglycidyl ether, p-aminophenol triglycidyl ether, polypropylene glycol diglycidyl ether, pentaerythritol tetraglycidyl ether, sorbitol polyglycidyl ether, trimethylolpropane triglycidyl ether, castor oil triglycidyl ether, diaminobiphenyl tetraglycidyl ether, soya oil epoxide, adipic acid, maleic acid, phthalic acid, maleic anhydride, succinic anhydride, dodecylsuccinic anhydride, phthalic anhydride, trimellitic anhydride, pyromellitic anhydride, dimethoxydimethylsilane, diethoxy-dimethylsilane, tetraalkoxysilane, toluene diisocyanate, diphenylmethane diisocyanate.

The specified crosslinkers and chemically related compounds are used preferably in the range from 0.1-10% by weight, particularly preferably 0.5-5% by weight and specifically 1.0-2.5% by weight, based on the polyglycerol.

It is usual and particularly preferred to carry out the crosslinking step after the glycerol condensation and before the alkoxylation. Crosslinking after glycerol condensation and its subsequent alkoxylation can likewise be carried out according to the invention.

The crosslinked polyglycerols obtained from the glycerol condensation and subsequent crosslinking are then alkoxylated with one or more $C_2$-$C_4$-alkylene oxides, preferably ethylene oxide (EO) or propylene oxide (PO). The alkoxylating agent is used in molar excess. The alkoxylation takes place, as known in the prior art, by reaction of the polyglycerols with an alkylene oxide under an increased pressure of generally 1.1 to 20 bar at temperatures of from 50 to 200° C. The alkoxylation takes place on the free OH groups of the polyglycerols. The amount of alkylene oxide used is sufficient for the average degree of alkoxylation to be between 1 and 100 alkylene oxide units per free OH group. Average degree of alkoxylation is understood here as meaning the average number of alkoxy units which is positioned on each free OH group. It is preferably 2 to 70, in particular 5 to 50, especially 20 to 40.

Preferably, the alkoxylation is carried out firstly with PO and then with EO. The ratio of EO to PO in the alkoxylated polyglycerol is preferably between 1:1 and 1:10. Though, according to the invention, the alkoxylation can also take place in reverse order, first ED then PO or with a mixture of PO and EO.

The polyglycerol obtained following condensation, subsequent crosslinking and alkoxylation preferably has a molecular weight of from 3000 to 50 000 units, in particular from 5000 to 30 000 units, especially from 8000 to 25 000.

The alkoxylated, crosslinked polyglycerols prepared by the described process are depicted by way of example, in the case of the crosslinker phthalic anhydride, by the following structure (formula 2):

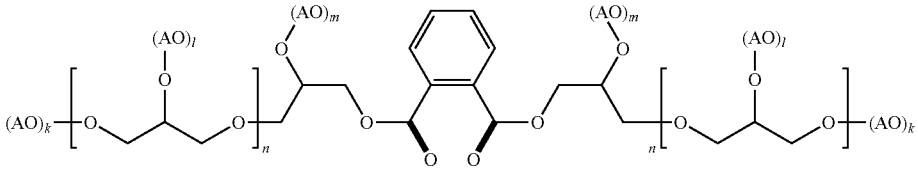

(2)

$(AO)_{k,l,m}O$ are the alkoxylated OH radicals in which AO is a $C_2$-$C_4$-alkylene oxide unit and k, l, m are the degrees of alkoxylation. n is the degree of condensation of the glycerol. n is preferably a number from 5 to 50, particularly preferably 8 to 30, especially 10 to 20.

The present invention preferably provides for the use of the alkoxylated polyglycerol as demulsifiers for oil/water emulsions in the recovery of petroleum.

For use as petroleum demulsifiers, the crosslinked alkoxylated polyglycerols are added to the water-oil emulsions, which preferably takes place in solution. Preferred solvents for the crosslinked alkoxylated polyglycerols are paraffinic or aromatic solvents. The crosslinked alkoxylated polyglycerols are used in amounts of from 0.0001 to 5% by weight, preferably 0.0005 to 2% by weight, in particular 0.0008 to 1% by weight and specifically 0.001 to 0.1% by weight, based on the oil content of the emulsion to be demulsified.

EXAMPLES

Example 1

Preparation of Pentadecaglycerol 100.0 g of glycerol and 3.7 g of NaOH (18% strength) were mixed in a 250 ml three-necked flask fitted with contact thermometer, stirrer and water separator. With stirring and nitrogen blanketing, the reaction mixture was heated rapidly to 240° C. At this temperature, the water of reaction was distilled off over 8 h. The product was evaporated to dryness on a rotary evaporator (yield: 67.3 g) and the molar mass was analyzed by GPC (M* ≈1100 g/mol, standard polyethylene glycol). The chain length n was determined via the OH number.

Example 2

Crosslinking of Pentadecaglycerol with Bisphenol a Diglycidyl Ether 250.0 g of pentadecaglycerol were heated to 80° C. under gentle nitrogen blanketing in a 500 ml three-necked flask fitted with contact thermometer, stirrer and reflux condenser. At this temperature, 13.2 g of bisphenol A diglycidyl ether (80% strength solution in an aromatic solvent) were quickly added dropwise. The reaction temperature was then increased to 120° C. and the reaction mixture was stirred for 8 h until unreacted diglycidyl ether could no longer be detected by means of titration of the epoxy number: The product was evaporated to dryness on a rotary evaporator (yield: 260.0 g) and the molar mass was analyzed by GPC (M*≈2600 g/mol, standard polyethylene glycol).

Example 3

Crosslinking of Pentadecaglycerol with Dodecylsuccinic Anhydride 100.0 g of pentadecaglycerol, 1.5 g of alkylbenzenesulfonic acid and 2.7 g of dodecylsuccinic anhydride were initially introduced at room temperature into a 250 ml three-necked flask fitted with contact thermometer, stirrer and water separator. The reaction mixture was then heated to 165° C. and stirred for a further 8 h at this temperature until no more water of reaction formed in the water separator (reaction control: acid number). The product was evaporated to dryness on a rotary evaporator (yield: 102.0 g) and the molar mass was analyzed by GPC (M*≈2450 g/mol, standard polyethylene glycol).

Example 4

Crosslinking of Pentadecaglycerol with Toluene 2,4-Diisocyanate 100.0 g of pentadecaglycerol were heated to 60° C. under gentle nitrogen blanketing in a 250 ml three-necked flask fitted with contact thermometer, stirrer and reflux condenser. At this temperature, 2.4 g of toluene 2,4-diisocyanate were then slowly added dropwise. The reaction temperature was increased to 100° C. and the reaction mixture was stirred for a further 8 h until at this temperature (reaction control: isocyanate number). The product was evaporated to dryness on a rotary evaporator (yield: 102.2 g) and the molar mass was analyzed by GPC (M*≈2380 g/mol, standard polyethylene glycol).

Example 5

Preparation of Decaglycerol 100.0 g of glycerol and 3.7 g of NaOH (18% strength) were mixed in a 250 ml three-necked flask fitted with contact thermometer, stirrer and water separator. With stirring and nitrogen blanketing, the reaction mixture was heated rapidly to 240° C. At this temperature, the water of reaction was distilled off over 5 h. The product was evaporated to dryness on a rotary evaporator (yield: 74.9 g) and analyzed by GPC (M*≈730 g/mol). The chain length n was determined via the OH number.

Example 6

Crosslinking of Decaglycerol with Bisphenol a Diglycidyl Ether 100.0 g of decaglycerol were heated to 80° C. under gentle nitrogen blanketing in a 250 ml three-necked flask fitted with contact thermometer, stirrer and reflux condenser. At this temperature, 3.0 g of bisphenol A diglycidyl ether (80% strength solution in an aromatic solvent) were quickly added dropwise. The reaction temperature was then increased to 120° C. and the reaction mixture was stirred for 8 h until unreacted diglycidyl ether could no longer be detected by means of titration of the epoxy number. The product was evaporated to dryness on a rotary-evaporator (yield: 102.3 g) and the molar mass was analyzed by GPC (M*≈1530 g/mol, standard polyethylene glycol).

Example 7

Crosslinking of Decaglycerol with Dodecylsuccinic Anhydride 100.0 g of decaglycerol, 1.5 g of alkylbenzenesulfonic acid and 2.5 g of dodecylsuccinic anhydride were initially introduced at room temperature into a 250 ml three-necked flask fitted with contact thermometer, stirrer and water separator. The reaction mixture was then heated to 165° C. and stirred for a further 8 h at this temperature until no more water of reaction formed in the water separator (reaction control: acid number). The product was evaporated to dryness on a rotary evaporator (yield: 101.8 g) and the molar mass was analyzed by GPC (M*≈1420 g/mol, standard polyethylene glycol).

Example 8

Crosslinking of Decaglycerol with Toluene 2,4-Diisocyanate 100.0 g of decaglycerol were heated to 60° C. under gentle nitrogen blanketing in a 250 ml three-necked flask fitted with contact thermometer, stirrer and reflux condenser. Then, at this temperature, 2.4 g of toluene 2,4-diisocyanate were slowly added dropwise. The reaction temperature was increased to 100° C. and the reaction mixture was stirred for a further 8 h at this temperature (reaction control: isocyanate number). The product was evaporated to dryness on a rotary evaporator (yield: 102.1 g) and the molar mass was analyzed by GPC (M*≈1650 g/mol, standard polyethylene glycol).

Alkoxylation of the Crosslinked Polyglycerols

Ethylene Oxide

The crosslinked polyglycerols described above were introduced into a 1 l glass autoclave and the pressure in the autoclave was adjusted to about 0.2 bar above atmospheric pressure with nitrogen. Heating was slowly carried out to 140° C. and, after this temperature had been reached, the pressure was again adjusted to 0.2 bar above atmospheric pressure. Then, at 140° C., the desired amount of EO (see table 1) was metered in, during which the pressure should not exceed 4.5 bar. When the addition of EO was complete, the mixture was left to after react for a further 30 minutes at 140° C.

Propylene Oxide

The crosslinked polyglycerols described above were introduced into a 1 l glass autoclave and the pressure in the autoclave was adjusted to about 0.2 bar above atmospheric pressure with nitrogen. Heating was slowly carried out to 130° C. and, after this temperature had been reached, the pressure was again adjusted to 0.2 bar above atmospheric pressure. Then, at 130° C., the desired amount of PO was metered in (see table 1), during which the pressure should not exceed 4.0 bar. When the addition of PO was complete, the mixture was left to after react for a further 30 minutes at 130° C.

The Degree of Alkoxylation was Determined by Means of $^{13}$C-NMR

Determination of the Demulsifying Effectiveness of Petroleum Demulsifiers

To determine the effectiveness of a demulsifier, the water separation from a crude oil emulsion per time, and also the dewatering and desalting of the oil were determined. For this, demulsifying glasses (tapered, graduated glass bottles with screw lids) were charged in each case with 100 ml of the crude oil emulsion, in each case a defined amount of the demulsifier was metered in just below the surface of the oil emulsion using a micropipette, and the demulsifier was mixed into the emulsion by intensive shaking. The demulsifying glasses were then placed in a conditioning bath (30° C. and 50° C.) and water separation was monitored.

During demulsification and after it had finished, samples were taken from the oil from the upper section of the demulsifying glass (so-called top oil), and the water content was determined in accordance with Karl Fischer and the salt content was determined conductometrically. In this way, it was possible to assess the novel demulsifiers according to water separation and also dewatering and desalting of the oil.

Demulsifying Action of the Demulsifiers Described

Origin of the crude oil emulsion: Holzkirchen sonde 3, Germany

| | |
|---|---|
| Water content of the emulsion: | 46% |
| Salt content of the emulsion: | 5% |
| Demulsification temperature: | 50° C. |

TABLE 1

Effectiveness of alkoxylated crosslinked polyglycerols as demulsifiers compared with the corresponding alkoxylated uncrosslinked polyglycerol and Dissolvan 4738 (dosing rate 20 ppm)

| Water separation [ml] per time [min] | 5 | 10 | 20 | 30 | 45 | 60 | 90 | 120 | 180 | Water in the top oil [%] | Salt in the top oil [ppm] |
|---|---|---|---|---|---|---|---|---|---|---|---|
| Product from 1 + 30 PO + 20 EO (comparison) | 2 | 6 | 12 | 21 | 28 | 36 | 40 | 42 | 43 | 0.85 | 156 |
| Product from 2 + 30 PO + 20 EO | 4 | 10 | 22 | 30 | 38 | 43 | 46 | 46 | 46 | 0.15 | 35 |
| Product from 3 + 30 PO + 20 EO | 6 | 13 | 27 | 35 | 42 | 45 | 46 | 46 | 46 | 0.13 | 25 |
| Product from 4 + 30 PO + 20 EO | 4 | 11 | 24 | 33 | 40 | 44 | 45 | 46 | 46 | 0.31 | 56 |
| Product from 5 + 40 PO + 30 EO (comparison) | 0 | 4 | 10 | 19 | 26 | 34 | 40 | 42 | 42 | 0.92 | 189 |
| Product from 6 + 40 PO + 30 EO | 3 | 12 | 25 | 33 | 40 | 44 | 46 | 46 | 46 | 0.11 | 12 |
| Product from 7 + 40 PO + 30 EO | 2 | 5 | 12 | 26 | 37 | 42 | 45 | 45 | 46 | 0.19 | 21 |
| Product from 8 + 40 PO + 30 EO | 5 | 14 | 28 | 35 | 42 | 43 | 45 | 46 | 46 | 0.15 | 19 |
| Standard: Dissolvan 4738 (comparision) | 0 | 0 | 0 | 5 | 11 | 25 | 32 | 38 | 39 | 0.97 | 220 |

TABLE 2

Biodegradability of alkoxylated, crosslinked polyglycerols (closed bottle test according to OECD 306) compared with the corresponding alkoxylated uncrosslinked polyglycerol and Dissolvan 4738

| | Biodegradability [%] after | |
|---|---|---|
| | 14 days | 28 days |
| Product from 1 + 30 PO + 20 EO (comparision) | 16.5 | 22.4 |
| Product from 2 + 30 PO + 20 EO | 33.5 | 46.1 |
| Product from 3 + 30 PO + 20 EO | 40.6 | 50.3 |
| Product from 4 + 30 PO + 20 EO | 38.5 | 53.4 |
| Product from 5 + 40 PO + 30 EO (comparision) | 10.5 | 19.5 |
| Product from 6 + 40 PO + 30 EO | 42.7 | 63.5 |
| Product from 7 + 40 PO + 30 EO | 38.2 | 58.3 |
| Product from 8 + 40 PO + 30 EO | 33.5 | 54.7 |
| Standard: Dissolvan 4738 (comparision) | 20.5 | 27.5 |
| Reference (sodium benzoate) (comparision) | 62.5 | 81.4 |

The invention claimed is:

1. A method for demulsifying an oil/water emulsion, said method comprising adding to said emulsion a crosslinked alkoxylated polyglycerol, said polyglycerol being the product of an acid- or alkali-catalyzed condensation of glycerol at temperatures between 200 °C. and 300 °C., crosslinked with a multifunctional electrophilic compound having a molecular weight of from 1000 to 100 000 units measured by gel permeation chromatography with standard polyethylene glycol and comprising 5 to 100 glycerol units which are alkoxylated with $C_2$-$C_4$-alkylene oxide groups or a mixture of such alkylene oxide groups so that the crosslinked alkoxylated polyglycerol has a degree of alkoxylation of from 1 to 100 alkylene oxide units per free OH group, said crosslinked alkoxylated polyglycerol being added to the oil/water emulsion in amounts of from 0.0001 to 5% by weight, based on the oil content of the emulsion to be demulsified.

2. The method of claim 1, in which the number of glycerol units is between 5 and 50.

3. The method of claim 1, where the alkoxylated, crosslinked polyglycerol has a molecular weight of from 3000 to 50 000 units.

4. The method of claim 1, in which the average degree of alkoxylation is between 1 and 70 alkylene oxide units per free OH group.

5. The method of claim 1, in which the alkylene oxide is ethylene oxide or propylene oxide.

6. The method of claim 1, in which a coalkoxylation with ethylene oxide and propylene oxide in the ratio of from 1:2 to 1:10 is present.

7. The method of claim 1, where the multifunctional electrophilic compound is selected from the group consisting of bisphenol A diglycidyl ether, butane-1,4-diol diglycidyl ether, hexane-1,6-diol diglycidyl ether, ethylene glycol diglycidyl ether, cyclohexanedimethanol diglycidyl ether, resorcinol diglycidyl ether, glycerol diglycidyl ether, glycerol triglycidyl ether, glycerol propoxylate triglycidyl ether, polyglycerol polyglycidyl ether, p-aminophenol triglycidyl ether, polypropylene glycol diglycidyl ether, pentaerythritol tetraglycidyl ether, sorbitol polyglycidyl ether, trimethylolpropane triglycidyl ether, castor oil triglycidyl ether, diaminobiphenyl tetraglycidyl ether, soya oil epoxide, adipic acid, maleic acid, phthalic acid, maleic anhydride, succinic anhydride, dodecylsuccinic anhydride, phthalic anhydride, trimellitic anhydride, pyromellitic anhydride, dimethoxydimethylsilane, diethoxydimethylsilane, toluene diisocyanate, diphenylmethane diisocyanate, and mixtures thereof.

8. The method of claim 1, where the crosslinking step is carried out after the alkoxylation of the polyglycerols.

* * * * *